US008800506B2

(12) United States Patent
Dougherty

(10) Patent No.: US 8,800,506 B2
(45) Date of Patent: Aug. 12, 2014

(54) ENGINE HAVING OPPOSED PISTONS AND OPPOSED CYLINDERS AND SIDE DUAL POWER OUTPUT SHAFTS

(76) Inventor: Thomas J. Dougherty, Waukesha, WI (US)

( * ) Notice: Subject to any disclaimer, the term of this patent is extended or adjusted under 35 U.S.C. 154(b) by 166 days.

(21) Appl. No.: 12/901,235

(22) Filed: Oct. 8, 2010

(65) Prior Publication Data

US 2011/0083644 A1 Apr. 14, 2011

Related U.S. Application Data

(60) Provisional application No. 61/250,439, filed on Oct. 9, 2009.

(51) Int. Cl.
*F01B 7/12* (2006.01)
*F02B 75/24* (2006.01)
*F02B 25/08* (2006.01)

(52) U.S. Cl.
CPC ..... *F02B 75/246* (2013.01); *F01B 7/12* (2013.01); *F02B 75/24* (2013.01); *F02B 25/08* (2013.01)
USPC ..... 123/51 R; 123/51 BC; 123/53.1; 123/53.2; 123/58.1; 123/63

(58) Field of Classification Search
CPC ..... F02B 25/08; F01B 7/02; F01B 7/12
USPC ..... 123/52.1, 53.1, 53.6, 55.2, 58.1, 63
See application file for complete search history.

(56) References Cited

U.S. PATENT DOCUMENTS

| | | | | | |
|---|---|---|---|---|---|
| 1,838,308 | A | * | 12/1931 | Higman | 123/50 R |
| 2,093,433 | A | * | 9/1937 | Greene | 123/51 BC |
| 2,093,869 | A | * | 9/1937 | Kahn | 123/41.31 |
| 2,388,756 | A | * | 11/1945 | Meyers | 123/51 BC |
| 2,781,749 | A | * | 2/1957 | Stucke | 123/51 BA |
| 2,953,294 | A | * | 9/1960 | Wachsmuth | 417/341 |
| 3,198,179 | A | * | 8/1965 | Stephens | 123/51 B |
| 3,319,416 | A | * | 5/1967 | Renshaw | 60/525 |
| 3,521,615 | A | * | 7/1970 | Trammell, Jr. | 123/197.1 |
| 3,708,979 | A | * | 1/1973 | Bush et al. | 60/522 |
| 4,658,768 | A | * | 4/1987 | Carson | 123/53.2 |
| 5,191,863 | A | * | 3/1993 | Hagiwara | 123/59.3 |
| 5,347,960 | A | * | 9/1994 | Tokumi | 123/63 |

* cited by examiner

*Primary Examiner* — Lindsay Low
*Assistant Examiner* — Kevin Lathers
(74) *Attorney, Agent, or Firm* — Quarles & Brady LLP

(57) ABSTRACT

The engine includes a cylinder; a first piston and a second piston that reciprocate in the cylinder wherein the first piston has a first end piston head; a first piston rod attached to the first piston at a second end of the first piston opposite the first end; wherein the second piston has a first end forming a second piston head; a second piston rod attached to the second piston at a second end opposite the first end of the second piston; a first connecting rod connected to the first piston rod and coupled to a power output shaft; and a second connecting rod connected to the second piston rod and coupled to the power output shaft. The first and second piston head move away from each other on a first power stroke of the first piston and a second power stroke of the second piston.

21 Claims, 8 Drawing Sheets

ENGINE HAVING OPPOSED PISTONS AND OPPOSED CYLINDERS AND SIDE DUAL POWER OUTPUT SHAFTS

CROSS-REFERENCES TO RELATED APPLICATIONS

This application claims priority from U.S. Provisional Patent Application No. 61/250,439 filed Oct. 9, 2009.

STATEMENT REGARDING FEDERALLY SPONSORED RESEARCH

Not Applicable.

BACKGROUND OF THE INVENTION

1. Field of the Invention

This invention relates to an engine having axial combustion chambers and axial pistons connected to side power output shafts.

2. Description of the Related Art

Various engine designs are known. For example, U.S. Pat. No. 6,769,384 discloses a radial piston engine wherein power is transferred such that the power take-off is truly balanced in that the piston runs truly parallel to the cylinder walls. This radial engine reduces wear of the cylinders and piston rings, provides improved gas mileage due to the reduced piston drag, and produces greater torque than other engine designs. Other engine designs are shown in U.S. Pat. Nos. 3,319,416 and 1,419,693.

U.S. Patent Application Publication No. 2008/0149052 shows and describes an engine having axially opposed cylinders.

However, there is still a need for further improvements in an inline piston engine: (i) where power take-off is truly balanced such that the piston runs truly parallel to the cylinder walls, (ii) that provides improved gas mileage by reducing piston drag, and (iii) that produces greater torque.

SUMMARY OF THE INVENTION

The foregoing needs are met by an engine according to the present invention. The engine includes a cylinder defining an interior space of the cylinder; a first piston that reciprocates in the interior space of the cylinder wherein the first piston has a first end forming a first piston head; a first piston rod attached to the first piston at a second end of the first piston opposite the first end of the first piston; a second piston that reciprocates in the interior space of the cylinder, wherein the second piston has a first end forming a second piston head; a second piston rod attached to the second piston at a second end of the second piston opposite the first end of the second piston; a first connecting rod connected to the first piston rod and coupled to a first power output shaft; and a second connecting rod connected to the second piston rod and coupled to the first power output shaft. The first piston head and the second piston head define a combustion chamber in the cylinder between the first piston head and the second piston head, and the first piston head and the second piston head move away from each other on a first power stroke of the first piston and a second power stroke of the second piston.

The first piston rod can be attached to the first piston such that the first piston rod extends diametrically across the second end of the first piston, and the second piston rod can be attached to the second piston such that the second piston rod extends diametrically across the second end of the second piston. A fuel intake port can be in fluid communication with the interior space of the cylinder, and an exhaust port can be in fluid communication with the interior space of the cylinder, wherein the fuel intake port and the exhaust port are located in opposite ends of the cylinder.

In one version of the engine, a third connecting rod is connected to the first piston rod and coupled to a second power output shaft, and a fourth connecting rod is connected to the second piston rod and coupled to the second power output shaft. In another version of the engine, the engine includes a third piston having a third end forming a third piston head wherein the first piston rod is attached to the third piston at a second end of the third piston opposite the first end of the third piston; and the engine includes a fourth piston having a fourth end forming a fourth piston head wherein the second piston rod is attached to the fourth piston at a second end of the fourth piston opposite the first end of the fourth piston.

In another version of the engine, the engine includes a first cylinder head at a first end of the cylinder; and a second cylinder head at a second end of the cylinder. The third piston moves toward the first cylinder head during the first power stroke of the first piston, and the fourth piston moves toward the second cylinder head during the second power stroke of the second piston. The engine can include a housing, a first end plate sealing a first open end of the housing, and a second end plate sealing a second open end of the housing. A section of the first end plate forms the first cylinder head, and a section of the second end plate forms the second cylinder head. The housing can comprise a pair of housing sections, and the pair of housing sections can be connected by a bearing wherein the first power output shaft rotates in the bearing.

The engine can include a cylinder block that divides the combustion chamber in the cylinder into a first combustion chamber volume adjacent the first piston head and a second combustion chamber volume adjacent the second piston head. The cylinder block can include a first fuel intake port for providing a fuel to the first combustion chamber volume and a second fuel intake port for providing the fuel to the second combustion chamber volume.

The third piston head can define a second combustion chamber in the cylinder between the third piston head and the first cylinder head, and the first cylinder head can include a third fuel intake port for providing a fuel to the second combustion chamber. The fourth piston head can define a third combustion chamber in the cylinder between the fourth piston head and the second cylinder head, and the second cylinder head can include a fourth fuel intake port for providing a fuel to the third combustion chamber.

The cylinder block can include a spark device for igniting fuel in the first combustion chamber volume and the second combustion chamber volume. The first cylinder head can include a spark device for igniting fuel in the second combustion chamber. The second cylinder head can include a spark device for igniting fuel in the third combustion chamber.

The engine can include a first air compression chamber, a first compression plate slidingly arranged in the first air compression chamber and in sealing contact with an inner surface of the first air compression chamber, and a first compression rod connected to the first piston rod and the first compression plate. The first compression plate compresses air in the first air compression chamber upon movement of the first piston rod. The engine can include a first fluid pump chamber, a first pump plate slidingly arranged in the first fluid pump chamber and in sealing contact with an inner surface of the first fluid pump chamber, and a first pump rod connected to the second piston rod and the first pump plate. The first pump plate pumps fluid from the first fluid pump chamber upon movement of the second piston rod. The housing can have a first channel in fluid communication with the first air compression chamber for transporting air from the first air compression chamber, and also a second channel in fluid communication with the first fluid pump chamber for transporting fluid from the first fluid pump chamber.

The engine can include a drive gear connected to the first power output shaft. The engine can further include a drive element selected from chains and belts, wherein the drive element is coupled to the drive gear.

In the engine, the first connecting rod can be coupled to a second power output shaft, and a second connecting rod can be coupled to the second power output shaft. The first power output shaft and the second power output shaft can be coaxial. The first connecting rod can be linked to a first set of cams, the second connecting rod can be linked to each of the first set of cams, the second connecting rod can be linked to a second set of cams, and one cam of the second set of cams can be connected to the first power output shaft, and another cam of the second set of cams can be connected to the second power output shaft. The second connecting rod can include a pair of spaced apart arms such that the first connecting rod and the first set of cams can move between the pair of spaced apart arms. The engine can further comprise: a second engine including a second cylinder defining an interior space of the second cylinder; a third piston that reciprocates in the interior space of the second cylinder; a third piston rod attached to the third piston; a fourth piston that reciprocates in the interior space of the second cylinder; a fourth piston rod attached to the fourth piston; and a second power output shaft coupled to the third piston rod and the fourth piston rod, wherein the first power output shaft is connected to the second power output shaft, and wherein a first cycle of the first piston and the second piston is 180 degrees out of phase with a second cycle of the third piston and the fourth piston.

It is therefore an advantage of the present invention to provide an engine that dramatically reduces cylinder friction and wear thereby improving gas mileage and lowering emissions.

It is another advantage of the present invention to provide an engine that has increased torque.

It is still another advantage of the present invention to provide an engine that allows for a low mass piston, which provides for higher speeds and greater horsepower.

It is yet another advantage of the present invention to provide an engine that can be used for standard internal combustion engines, diesel and 2 cycle designs. It can also be used as a pump if the power is reversed.

It is still another advantage of the present invention to provide an engine that requires a smaller block and can be mounted sideways.

It is yet another advantage of the present invention to provide an engine that is suitable for off road vehicles such as ATVs and military equipment.

It is still another advantage of the present invention to provide an engine, pump, compressor or the like that has the upper pistons and lower pistons connected to the same two power output shafts.

It is still another advantage of the present invention to provide an engine, pump, compressor or the like that has the two middle pistons forming a single combustion chamber.

It is yet another advantage of the present invention to provide an engine, pump, compressor or the like that has one or more of the shafts coming out of the cylinder that connect to a push rod and plates that compress air in the resulting chambers. These chambers compress air in both an up and down motion.

It is still another advantage of the present invention to provide an engine, pump, compressor or the like that has one or more of the shafts coming out of the cylinder that connect to a push rod that pumps oil in a resulting chamber.

It is yet another advantage of the present invention to provide an engine, pump, compressor or the like that has two power output shafts located between the upper pistons and lower pistons, either directly below the cylinder, or off to the side.

It is still another advantage of the present invention to provide an engine, pump, compressor or the like that has a housing that is extruded, enabled by the design of the pistons and cranks. This housing by design also has channels for water and oil flow either extruded in the housing or molded, cast or added to the inside or outside of the housing.

It is yet another advantage of the present invention to provide an engine, pump, compressor or the like that has a design that allows for either a two cycle or four cycle engine by adding valves to the piston push rods or chains or belts to the power output shafts. The chains, belts and push rods can be split between both power output shafts or connected just to one power output shaft.

It is still another advantage of the present invention to provide an engine, pump, compressor or the like that has four push rods that are connected directly to a flange designed onto the upper pistons and lower pistons or to a shaft that extends through both sides of the upper pistons and lower pistons.

It is yet another advantage of the present invention to provide an engine, pump, compressor or the like that has a top plate housing, a bottom plate housing, and a middle housing.

It is still another advantage of the present invention to provide an engine, pump, compressor or the like that has bearings for power output shafts wherein the bearings are housed between two engine housing halves that connect both engine housing halves.

It is yet another advantage of the present invention to provide an engine, pump, compressor or the like that has four push rods where two of the push rods are Y-shaped or U-shaped to allow for a symmetric distribution of power from the upper pistons and lower pistons.

It is still another advantage of the present invention to provide an engine, pump, compressor or the like that has valves that are either rocker arm type valves, slide valves or rotary type valves (Coates valves).

It is yet another advantage of the present invention to provide an engine, pump, compressor or the like that has a fuel injector and a spark plug in the top plate housing, the bottom plate housing, and the middle cylinder block respectively, or aspiration with gas or diesel fuel.

It is still another advantage of the present invention to provide an engine, pump, compressor or the like that is connected to a second four cylinders that are at 90° or 180° out of phase and connect to the two power output shafts of the first engine half allowing for increased power and a smother running engine.

These and other features, aspects, and advantages of the present invention will become better understood upon consideration of the following detailed description, drawings, and appended claims.

BRIEF DESCRIPTION OF THE DRAWINGS

Like reference numerals are used to depict like parts from Figure to Figure throughout the drawings.

DETAILED DESCRIPTION OF THE INVENTION

Figure 1:
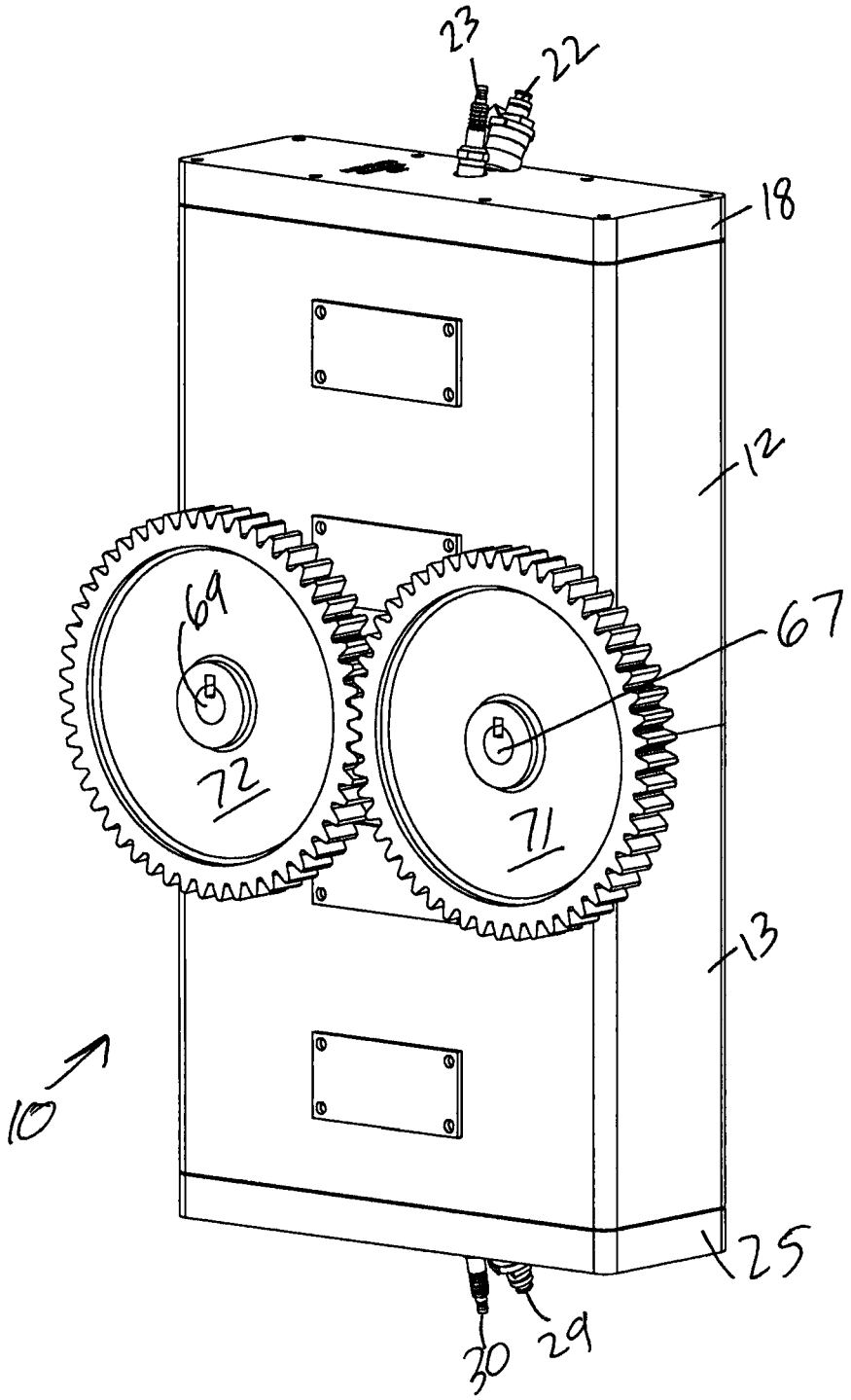
FIG. 1 is a perspective view of a first embodiment of an engine according to the invention.
Figure 2:
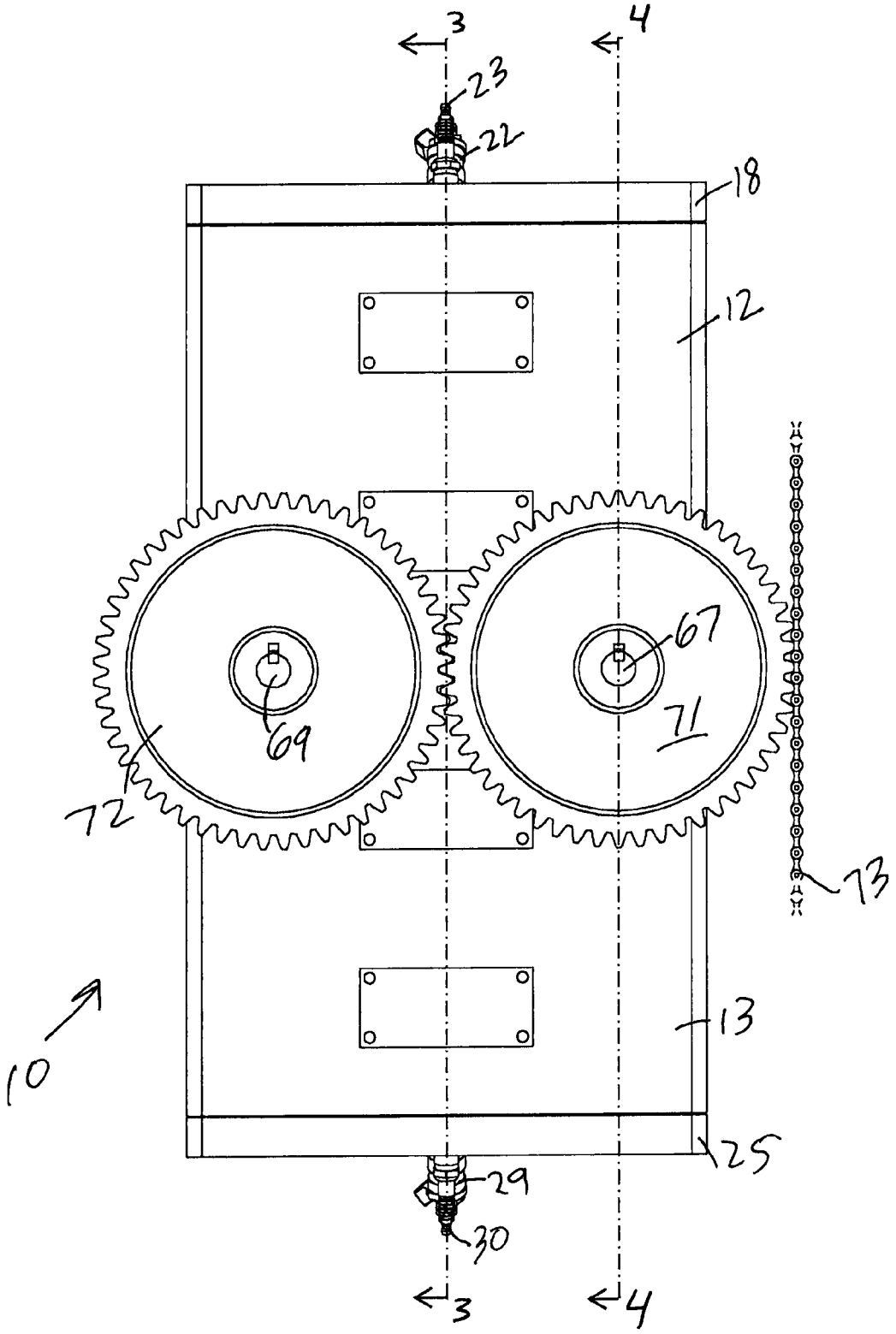
FIG. 2 is a front view of the engine of FIG. 1.
Figure 3:
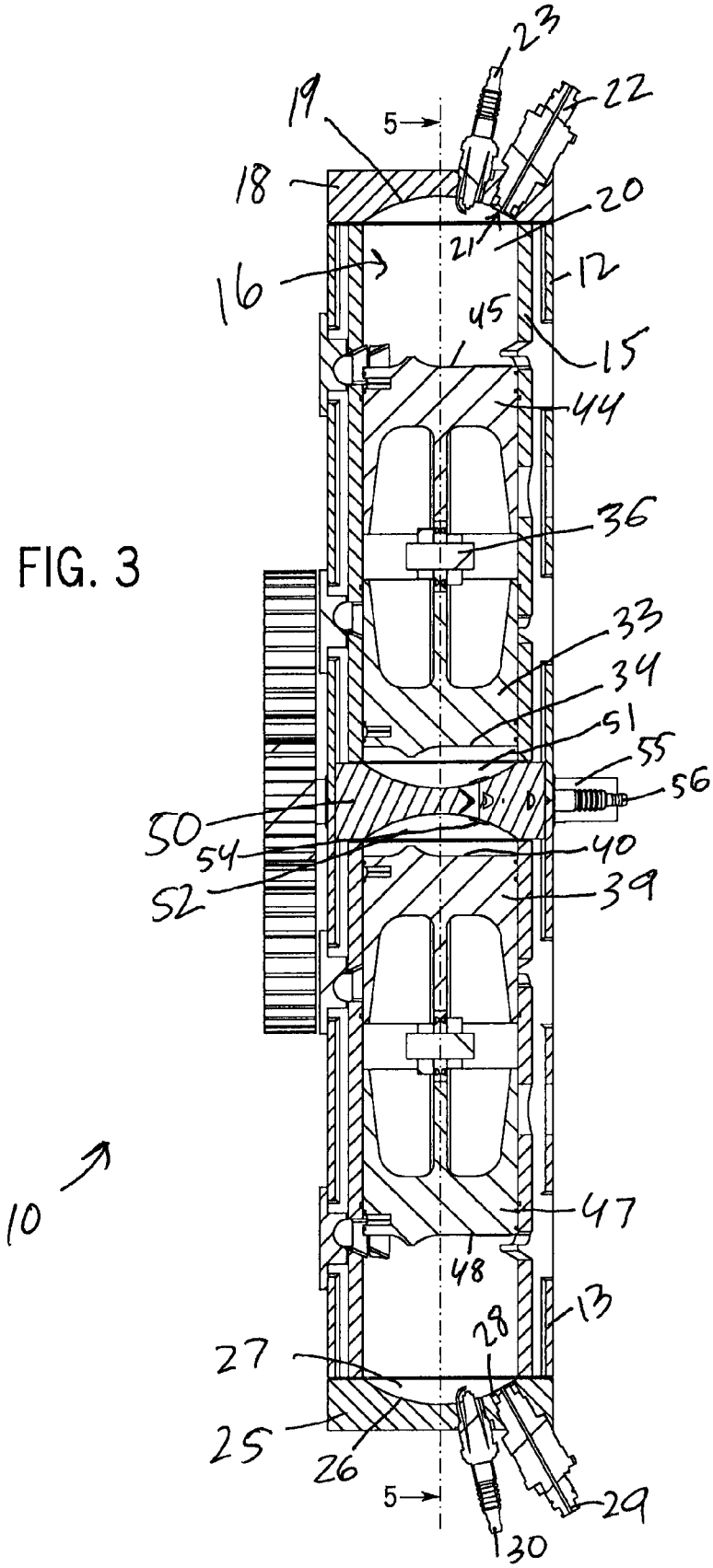
FIG. 3 is a cross-sectional view taken along line 3-3 of FIG. 2.

The present invention is directed to a piston engine wherein the power take-off is truly balanced and the piston runs truly parallel to the cylinder walls. Looking at FIGS. 1-6, a first example embodiment of an engine 10 includes a first top outer housing section 12 and a second bottom outer housing section 13 which may be extruded in the hollow generally rectangular shape shown in FIGS. 1-6. The housing section 12 and the housing section 13 are mated to form an internal cylinder 15 that extends from a top end to a bottom end of the engine 10. The cylinder 15 defines a cylindrical interior space 16. It should be understood that the terms "bottom", "top", "left" and "right" are used for ease and clarity of description, and in no way do these terms limit the orientation of the engine 10 in operation.

An open end of the top housing section 12 is closed off by a first end plate 18 that forms a first cylinder head 19 for the cylinder 15. A combustion chamber 20 is defined below the first cylinder head 19 for the cylinder 15. A fuel intake port 21 with a fuel injector 22 and a spark plug 23 are arranged in the first cylinder head 19. Optionally, a carburetor can be associated with the fuel intake port 21, or the spark plug can be omitted. Each fuel injector or carburetor is positioned for directing fuel and/or intake air in its associated intake port. The operation of internal combustion engines is well known and will not be explained further.

An open end of the bottom housing section 13 is closed off by a second end plate 25 that forms a second cylinder head 26 for the cylinder 15. A combustion chamber 27 is defined above the second cylinder head 26 for the cylinder 15. A fuel intake port 28 with a fuel injector 29 and a spark plug 30 are arranged in the second cylinder head 26 for the cylinder 15. Optionally, a carburetor can be associated with the fuel intake port 28, or the spark plug can be omitted. The top housing section 12, the bottom housing section 13, the first end plate 18, and the second end plate 25 can be formed from, for example, an aluminum alloy, a steel alloy, or a composite material.

The engine 10 includes a first piston 33 slidingly arranged in the interior space 16 of the cylinder 15. The first piston 33 is in sealing contact with an inner surface of the cylinder 15. The first piston 33 reciprocates in the interior space 16 of the cylinder 15. The first piston 33 includes a first piston head 34. At the end of the first piston 33 opposite the first piston head 34, one or more flanges of the first piston 33 are connected to a first piston rod 36 which extends diametrically across the end of the first piston 33.

The engine 10 includes a second piston 39 slidingly arranged in the interior space 16 of the cylinder 15. The second piston 39 is in sealing contact with an inner surface of the cylinder 15. The second piston 39 reciprocates in the interior space 16 of the cylinder 15. The second piston 39 includes a second piston head 40. At the end of the second piston 39 opposite the second piston head 40, one or more flanges of the second piston 39 are connected to a second piston rod 42 which extends diametrically across the end of the second piston 39.

The engine 10 includes a third piston 44 slidingly arranged in the interior space 16 of the cylinder 15. The third piston 44 is in sealing contact with an inner surface of the cylinder 15. The third piston 44 reciprocates in the interior space 16 of the cylinder 15. The third piston 44 includes a third piston head 45. At the end of the third piston 44 opposite the third piston head 45, one or more flanges of the third piston 44 are connected to the first piston rod 36 which extends diametrically across the end of the third piston 44.

The engine 10 includes a fourth piston 47 slidingly arranged in the interior space 16 of the cylinder 15. The fourth piston 47 is in sealing contact with an inner surface of the cylinder 15. The fourth piston 47 reciprocates in the interior space 16 of the cylinder 15. The fourth piston 47 includes a fourth piston head 48. At the end of the fourth piston 47 opposite the fourth piston head 48, one or more flanges of the fourth piston 47 are connected to the second piston rod 42 which extends diametrically across the end of the fourth piston 47.

Each of the pistons 33, 39, 44, 47 can have a pair of O-rings on its outer surface. A first of the pair of O-rings for each of the pistons 33, 39, 44, 47 is an oil wiping ring located at the end of each of the pistons 33, 39, 44, 47 that connects to the adjacent piston. This O-ring seals oil from the inside of the associated combustion chamber. A second of the pair of O-rings for each of the pistons 33, 39, 44, 47 is located about ⅔ to ¾ of the way to the end of each of the pistons 33, 39, 44, 47 near the associated combustion chamber. This O-ring seals off the combustion chamber.

The engine 10 includes a cylinder block 50 that defines a first combustion chamber volume 51 between the cylinder block 50 and the first piston head 34, and that defines a second combustion chamber volume 52 between the cylinder block 50 and the second piston head 40. A first fuel intake port 53, a second fuel intake port 54, a fuel injector 55, and a spark plug 56 are provided in the cylinder block 50. The first fuel intake port 53 can provide fuel from the fuel injector 55 to the first combustion chamber volume 51. The second fuel intake port 54 can provide fuel from the fuel injector 55 to the second combustion chamber volume 52. The spark plug 56 can ignite fuel in the first combustion chamber volume 51 and the second combustion chamber volume 52.

Figure 4:
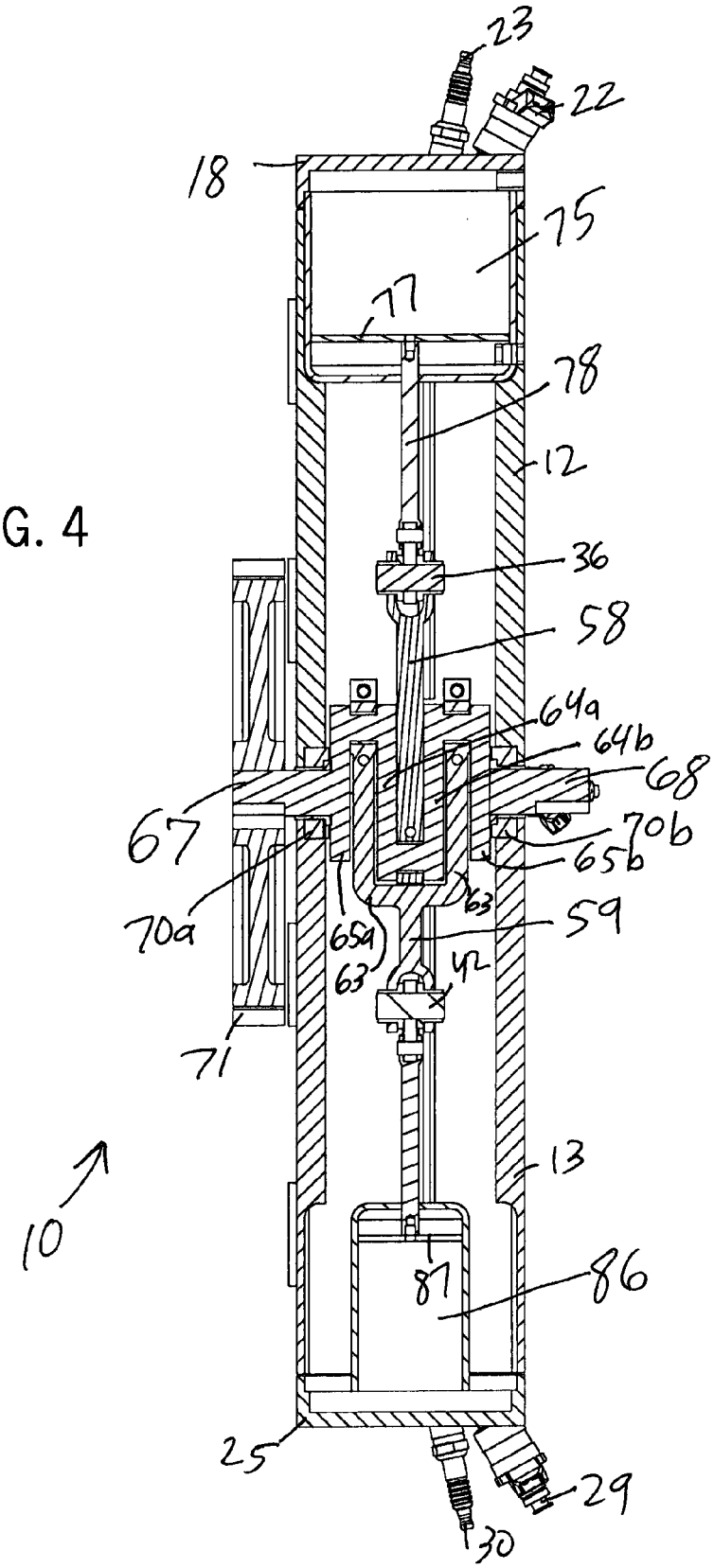
FIG. 4 is a cross-sectional view taken along line 4-4 of FIG. 2.
Figure 6:
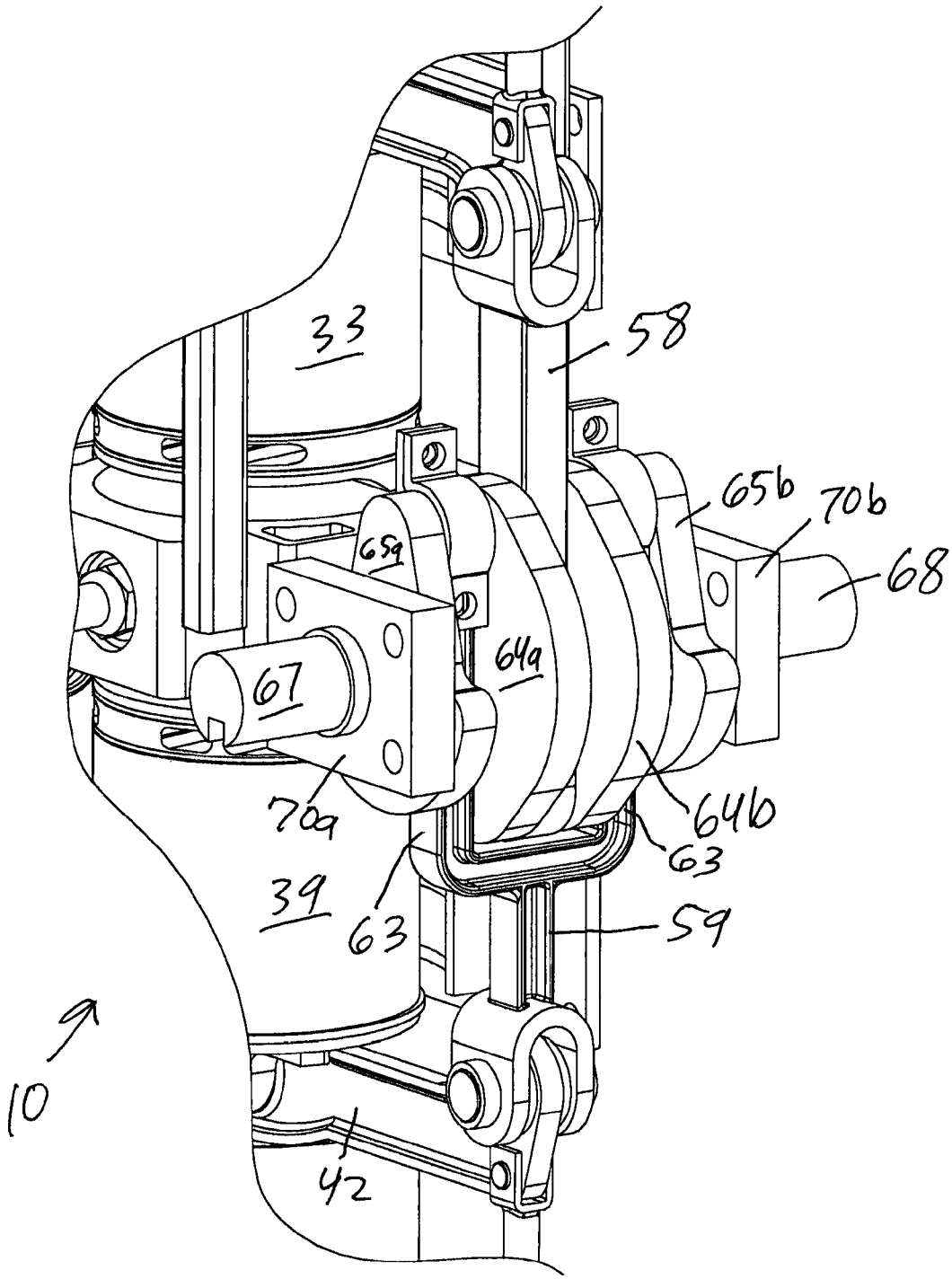
FIG. 6 is a right front perspective detailed view taken along line 6-6 of FIG. 5 showing the linkage between the connecting rods and the power output shafts on one side of the engine of FIGS. 1-6.

The engine 10 includes a first connecting rod 58 that is attached by a pin to the first piston rod 36, a second connecting rod 59 that is attached by a pin to the second piston rod 42, a third connecting rod 60 that is attached by a pin to the first piston rod 36. and a fourth connecting rod 61 that is attached by a pin to the second piston rod 42. Referring to FIGS. 4 and 6, the first connecting rod 58 is connected to a first set of cams 64*a*, 64*b* and the second connecting rod 59 is connected by spaced apart arms 63 to a second set of cams 65*a*, 65*b*. Cam 65*a* is connected to a first power output shaft 67, and cam 65*b* is connected to a second power output shaft 68. A third power output shaft 69 and a fourth power output shaft (not shown) are connected to the third connecting rod 60 and the fourth connecting rod 61 in the same manner as the connections between the first connecting rod 58, the second connecting rod 59, the first power output shaft 67, and the second power output shaft 68. A bearing plate 70*a* connects both the top housing section 12 and the bottom housing section 13, and also acts as bearing surface for the first output shaft 67. Likewise, a bearing plate 70*b* connects both the top housing section 12 and the bottom housing section 13, and also acts as bearing surface for the second power output shaft 68. Similar bearing plates are provided for the third power output shaft 69 and the fourth power output shaft.

A first drive gear 71 is connected to the first power output shaft 67, and a second drive gear 72 is connected to the third power output shaft 69 as shown in FIG. 1. A chain 73 can transmit motion from the first drive gear 71 (see FIG. 2). Similar drive gears and chains can be provided on the second power output shaft 68 and the fourth power output shaft.

The engine 10 includes a first air compression chamber 75 adjacent the first end plate 18. A first compression plate 77 is slidingly arranged in the first air compression chamber 75, and the first compression plate 77 is in sealing contact with an inner surface of the first air compression chamber 75. A first compression rod 78 is connected to the first compression plate 77. The first compression rod 78 is also connected to the first piston rod 36 by a pin 79. The first compression plate 77 compresses air in the first air compression chamber 75. The air is compressed in both an up and down motion. A channel 80 is in fluid communication with the first air compression chamber 75 for transporting air from the first air compression chamber 75. The channel can be extruded in the top housing section 12 and/or the bottom housing section 13, or molded, cast or added to the top housing section 12 and/or the bottom housing section 13.

The engine 10 includes a second air compression chamber 81 adjacent the first end plate 18. A second compression plate 82 is slidingly arranged in the second air compression chamber 81, and the second compression plate 82 is in sealing contact with an inner surface of the second air compression chamber 81. A second compression rod 83 is connected to the second compression plate 82. The second compression rod 83 is also connected to the first piston rod 36 by a pin 84. The second compression plate 82 compresses air in the second air compression chamber 81. The air is compressed in both an up and down motion. A channel is in fluid communication with the second air compression chamber 81 for transporting air from the second air compression chamber 81. The channel can be extruded in the top housing section 12 and/or the bottom housing section 13, or molded, cast or added to the top housing section 12 and/or the bottom housing section 13.

The engine 10 includes a first fluid pump chamber 86 adjacent the second end plate 25. A first pump plate 87 is slidingly arranged in the first fluid pump chamber 86, and the first pump plate 87 is in sealing contact with an inner surface of the first fluid pump chamber 86. A first pump rod 88 is connected to the first pump plate 87. The first pump rod 88 is also connected to the second piston rod 42 by a pin 89. The first pump plate 87 pumps fluid from the first fluid pump chamber 86 upon movement of the second piston rod 42. A channel is in fluid communication with the first fluid pump chamber 86 for transporting air from the first fluid pump chamber 86. The channel can be extruded in the top housing section 12 and/or the bottom housing section 13, or molded, cast or added to the top housing section 12 and/or the bottom housing section 13.

The engine 10 includes a second fluid pump chamber 91 adjacent the second end plate 25. A second pump plate 93 is slidingly arranged in the second fluid pump chamber 91, and the second pump plate 93 is in sealing contact with an inner surface of the second fluid pump chamber 91. A second pump rod 94 is connected to the second pump plate 93. The second pump rod 94 is also connected to the second piston rod 42 by a pin 95. The second pump plate 93 pumps fluid from the second fluid pump chamber 91 upon movement of the second piston rod 42. A channel 96 is in fluid communication with the second fluid pump chamber 91 for transporting air from the second fluid pump chamber 91. The channel can be extruded in the top housing section 12 and/or the bottom housing section 13, or molded, cast or added to the top housing section 12 and/or the bottom housing section 13.

Figure 5:
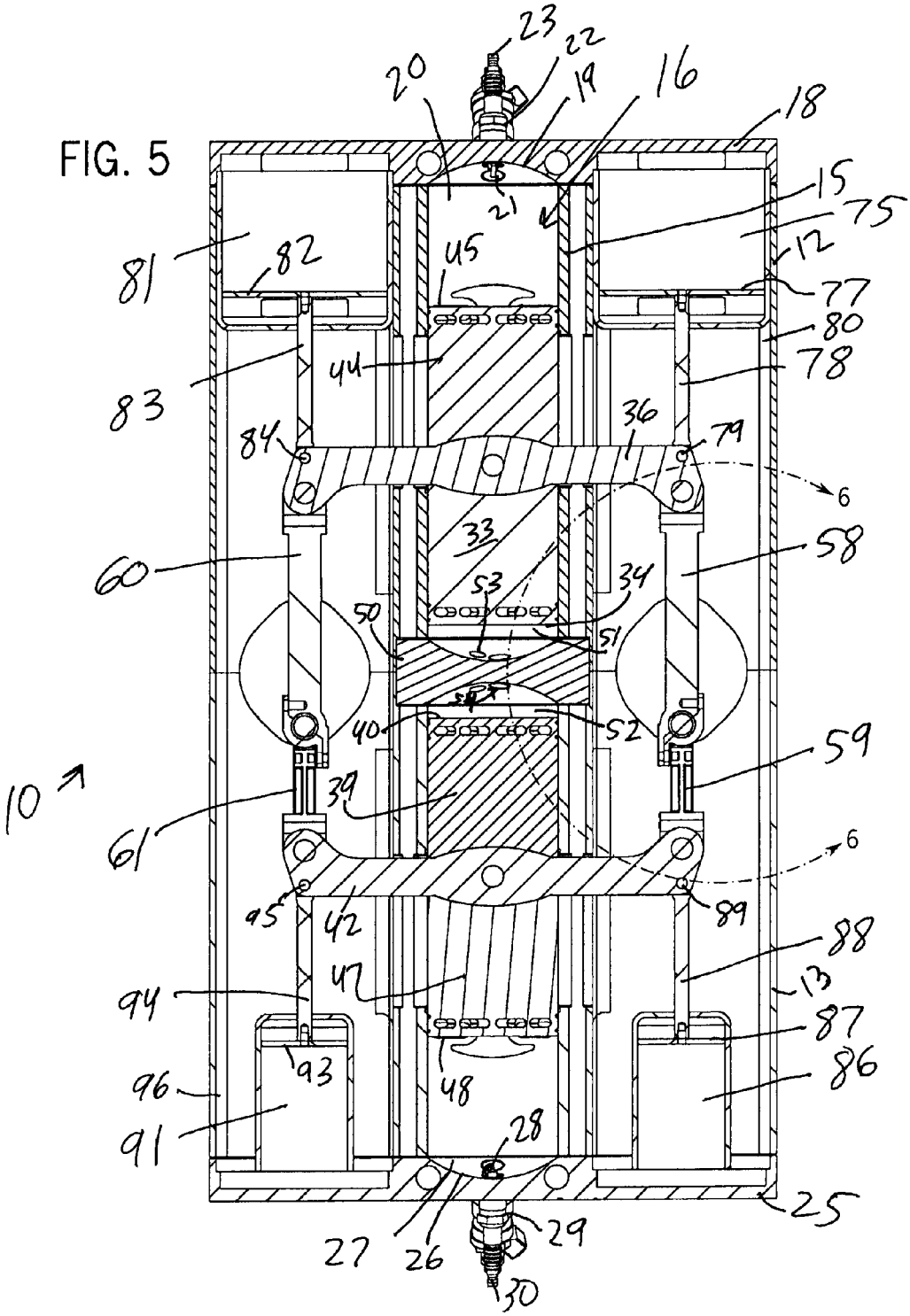
FIG. 5 is a cross-sectional view taken along line 5-5 of FIG. 3.

In FIG. 5, the first piston 33 and the third piston 44 (which are connected to the first piston rod 36) are shown near bottom of their stroke, and the second piston 39 and the fourth piston 47 (which are connected to the second piston rod 42) are shown near top of their stroke. At the time in the engine cycle shown in FIG. 5, the spark plug 56 will fire, fuel and air in the first combustion chamber volume 51 and the second combustion chamber volume 52 has been compressed, and when the spark plug 56 fires, the fuel-air mixtures ignite. The resulting explosions drive the second piston 39 and the fourth piston 47 downward and the first piston 33 and the third piston 44 upward.

When the first piston 33 and the third piston 44 are near top of their motion, and the second piston 39 and the fourth piston 47 are near bottom of their motion, the spark plugs 23,30 will fire, fuel and air in the combustion chambers 20, 27 has been compressed, and when the spark plugs 23,30 fire, the fuel-air mixtures ignite. The resulting explosion drives the first piston 33 and the third piston 44 downward and the second piston 39 and the fourth piston 47 upward.

As the first piston 33 and the third piston 44 reciprocate, the first piston rod 36 rotates the first set of cams 64*a*, 64*b*, the first piston rod 36 translates the first compression rod 78 such that the first compression plate 77 compresses air in the first air compression chamber 75, and the first piston rod 36 translates the second compression rod 83 such that the second compression plate 82 compresses air in the second air compression chamber 81. As the first piston 33 and the third piston 44 reciprocate, the first piston rod 36 rotates a set of cams (similar to the first set of cams 64*a*, 64*b*) on the opposite side of the cylinder. Rotation of the first set of cams 64*a*, 64*b* provides rotation to the first power output shaft 67 and second power output shaft 68, and rotation of the similar set of cams on the opposite side of the cylinder 15 provides rotation to the third power output shaft 69 and the fourth power output shaft.

As the second piston 39 and the fourth piston 47 reciprocate, the second piston rod 42 rotates the second set of cams 65*a*, 65*b* (and the similar set of cams on the opposite side of the cylinder 15), the second piston rod 42 translates the first pump rod 88 such that the first pump plate 87 pumps fluid from the first fluid pump chamber 86, and the second piston rod 42 translates the second pump rod 94 such that the second pump plate 93 pumps fluid from the second fluid pump chamber 91. Rotation of the second set of cams 65*a*, 65*b* provides rotation to the first power output shaft 67 and second power output shaft 68. Rotation of a set of cams (similar to the second set of cams 65*a*, 65*b*) provides rotation to the third power output shaft 69 and fourth power output shaft.

Figure 7:
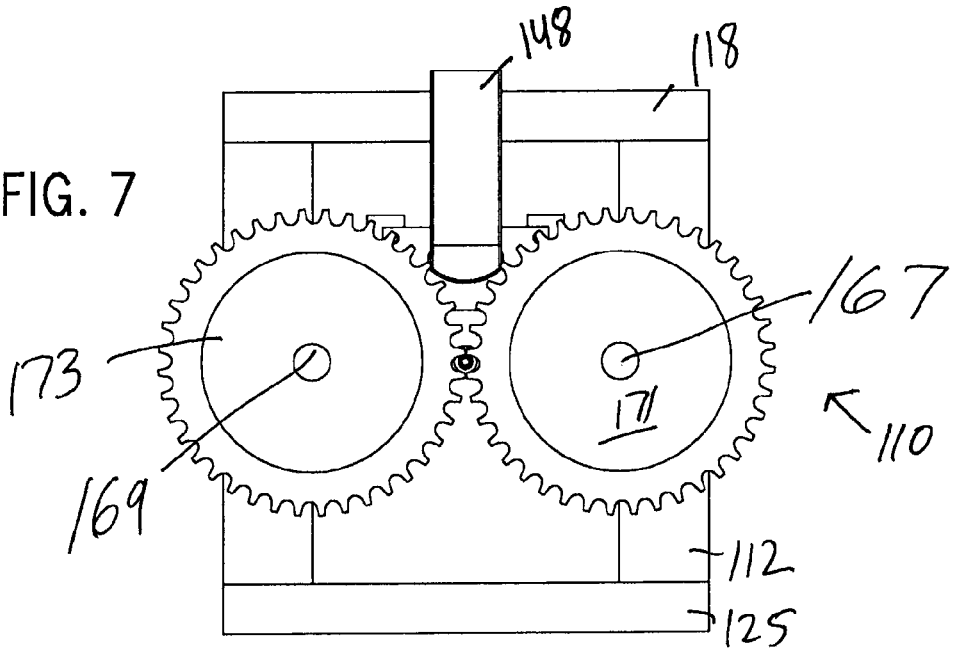
FIG. 7 is a front view of a second embodiment of an engine according to the invention.
Figure 8:
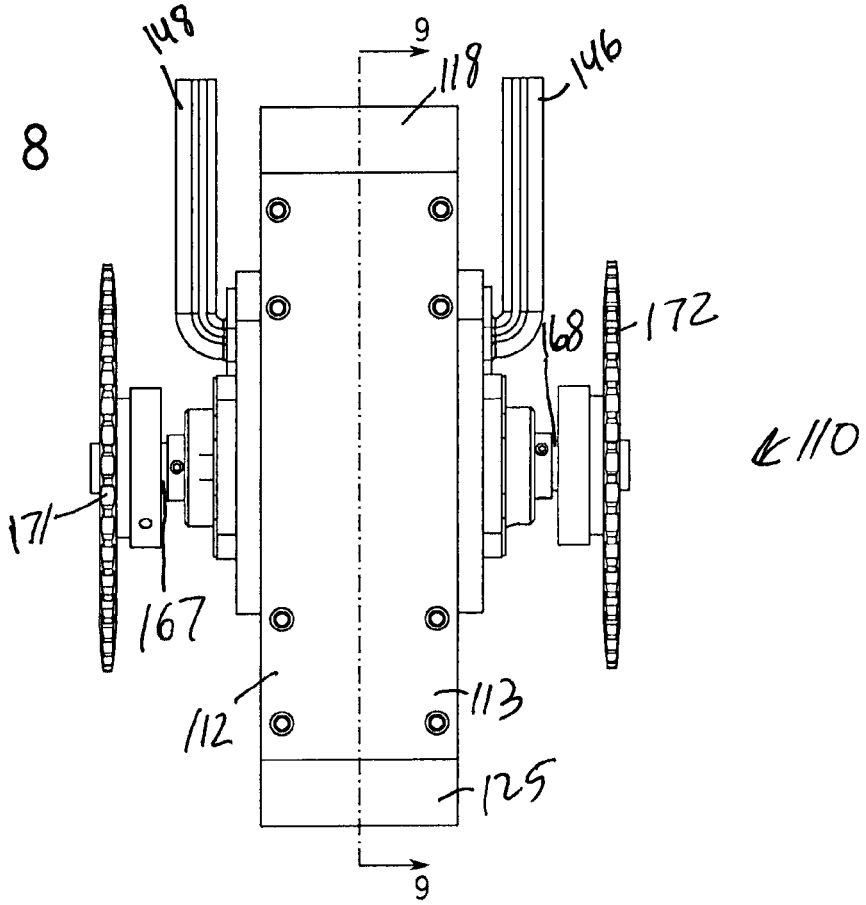
FIG. 8 is side view of the engine of FIG. 7.
Figure 9:
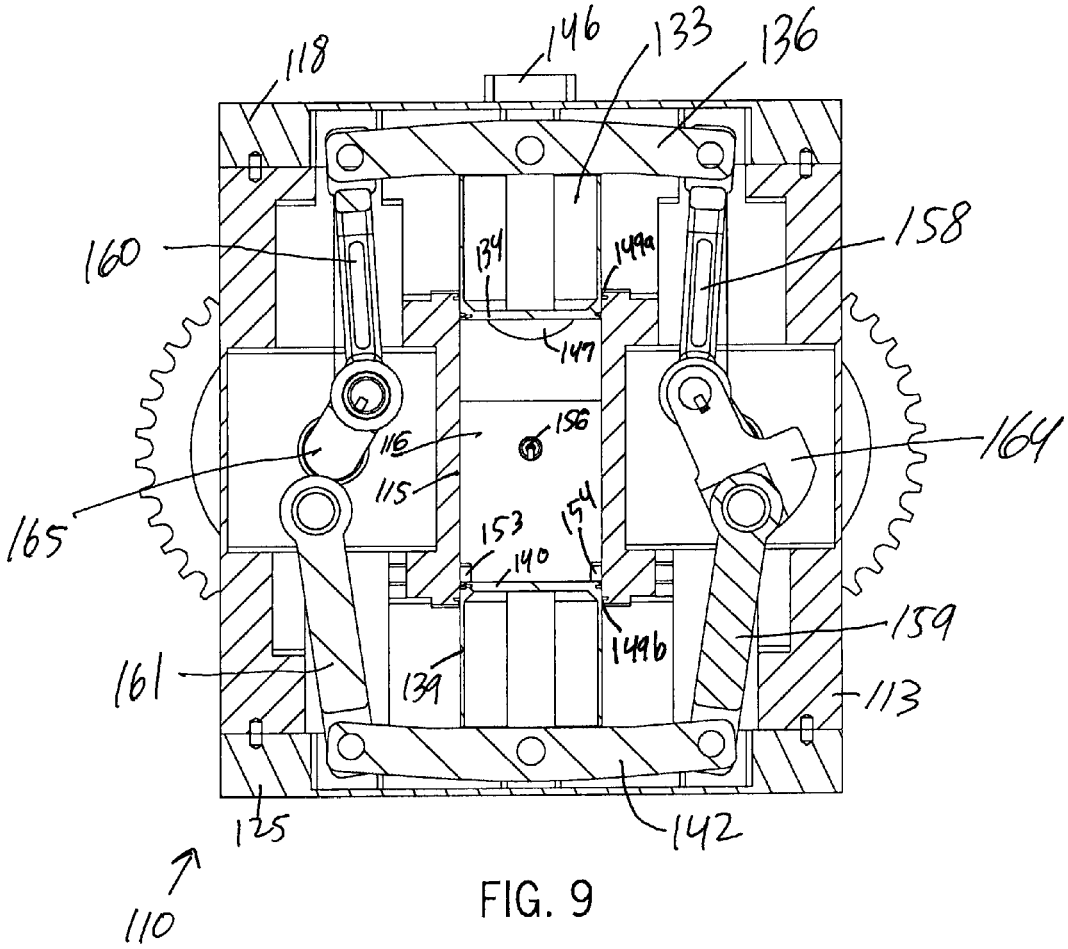
FIG. 9 is a cross-sectional view taken along line 9-9 of FIG. 8.

Looking at FIGS. 7-9, a second example embodiment of an engine 110 is shown. The engine 110 includes a first outer housing section 112 and a second outer housing section 113 which may be extruded in the hollow generally rectangular shape shown in FIGS. 7-9. The housing section 112 and the housing section 113 can be formed from, for example, an aluminum alloy, a steel alloy, or a composite material. The housing section 112 and the housing section 113 are mated to form an internal cylinder 115 that extends from a top end to a bottom end of the engine 110. The cylinder 115 defines a cylindrical combustion chamber 116. An open end of the housing sections 112, 113 is closed off by a first end plate 118. An opposite open end of the housing sections 112,113 is closed off by a second end plate 125. It should be understood that the terms "bottom", "top", "left" and "right" are used for ease and clarity of description, and in no way do these terms limit the orientation of the engine 110 in operation.

The engine 110 includes a first piston 133 slidingly arranged in the combustion chamber 116 of the cylinder 115. The first piston 133 is in sealing contact with an inner surface of the cylinder 115. The first piston 133 reciprocates in the combustion chamber 116 of the cylinder 115. The first piston 133 includes a first piston head 134. At the end of the first piston 133 opposite the first piston head 134, one or more flanges of the first piston 133 are connected to a first piston rod 136 which extends diametrically across the end of the first piston 133.

The engine 110 includes a second piston 139 slidingly arranged in the combustion chamber 116 of the cylinder 115. The second piston 139 is in sealing contact with an inner surface of the cylinder 115. The second piston 139 reciprocates in the combustion chamber 116 of the cylinder 115. The second piston 139 includes a second piston head 140. At the end of the second piston 139 opposite the second piston head 140, one or more flanges of the second piston 139 are connected to a second piston rod 142 which extends diametrically across the end of the second piston 139.

Each of the pistons 133, 139 can have one or more O-rings on its outer surface. Oil ring slots and associated O-rings 149*a*, 149*b* are provided in the cylinder to seal oil from the inside of the combustion chamber 116.

Fuel intake ports 153, 154 and a spark plug 156 are provided in the cylinder 115. The fuel intake ports 153, 154 can provide fuel to the combustion chamber 116. The spark plug 156 can ignite fuel in the combustion chamber 116. The engine 110 further includes a first exhaust pipe 146 in fluid communication with an exhaust port 147 in the cylinder 115, and a second exhaust pipe 148 in fluid communication with another exhaust port (not shown) in the cylinder 115. The fuel intake ports 153, 154 and exhaust ports 147 are at opposite ends of the cylinder 115.

The engine 110 includes a first connecting rod 158 that is attached by a pin to the first piston rod 136, a second connecting rod 159 that is attached by a pin to the second piston rod 142, a third connecting rod 160 that is attached by a pin to the first piston rod 136. and a fourth connecting rod 161 that is attached by a pin to the second piston rod 142. Referring to FIG. 9, the first connecting rod 158 and the second connecting rod 159 are connected to a first set of cams 164. The third connecting rod 160 and the fourth connecting rod 161 are connected to a second set of cams 165. Cams 164 are connected to a first power output shaft 167 and a second power output shaft 168. Cams 165 are connected to third power output shaft 169 and a fourth power output shaft (not shown).

The first connecting rod 158, the second connecting rod 159 and the first set of cams 164 of the engine 110 can be constructed and assembled in the manner shown in FIG. 6 for engine 10. Likewise, the third connecting rod 160, the fourth connecting rod 161, and the second set of cams 165 of the engine 110 can be constructed and assembled in the manner shown in FIG. 6 for engine 10.

A first drive gear 171 is connected to the first power output shaft 167, a second drive gear 172 is connected to the second power output shaft 168, and a third drive gear 173 is connected to the third power output shaft 169 as shown in FIGS. 7-8. A chain can transmit motion from any of the drive gears as in the embodiment of FIG. 2. A similar drive gear and chain can be provided on the fourth power output shaft.

In FIG. 9, the first piston 133, which is connected to the first piston rod 136, is shown near the top of its stroke, and the second piston 139, which is connected to the second piston rod 142, is shown near the bottom of its stroke. When the first piston 133 is near bottom of its motion, and the second piston 139 is near top of its motion, the spark plug will fire, fuel and air in the combustion chamber 116 has been compressed, and when the spark plug fires, the fuel-air mixture ignites. The resulting explosion drives the first piston 133 upward and the second piston 139 downward back to the positions shown in FIG. 9.

As the first piston 133 reciprocates, the first piston rod 136 rotates the first set of cams 164 and the second set of cams 165. As the second piston 139 reciprocates, the second piston rod 142 also rotates the first set of cams 164 and the second set of cams 165. Rotation of the first set of cams 164 provides rotation to the first power output shaft 167 and second power output shaft 168. Rotation of the second set of cams 165 provides rotation to the third power output shaft 169 and fourth power output shaft.

Thus, the invention provides an engine where power take-off is truly balanced such that the piston runs truly parallel to the cylinder walls, that provides improved gas mileage by reducing piston drag, and that produces greater torque.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. An engine comprising:

a cylinder defining an interior space of the cylinder;

a first piston that reciprocates in the interior space of the cylinder, the first piston having a first end forming a first piston head;

a first piston rod attached to the first piston at a second end of the first piston opposite the first end of the first piston, the first piston rod extending laterally beyond opposite sides of the cylinder;

a second piston that reciprocates in the interior space of the cylinder, the second piston having a first end forming a second piston head;

a second piston rod attached to the second piston at a second end of the second piston opposite the first end of the second piston, the second piston rod extending laterally beyond the opposite sides of the cylinder;

a third piston having a third end forming a third piston head, the first piston rod being attached to the third piston at a second end of the third piston opposite the first end of the third piston;

the first piston and the third piston being independently connected to the first piston rod by a first pin;

a first connecting rod connected to the first piston rod and coupled to a first power output shaft; and a second connecting rod connected to the second piston rod and coupled to the first power output shaft, a third connecting rod connected to the first piston rod and coupled to a second power output shaft; and a fourth connecting rod connected to the second piston rod and coupled to the second power output shaft, wherein the first piston head and the second piston head define a combustion chamber in the cylinder between the first piston head and the second piston head, and wherein the first piston head and the second piston head move away from each other on a first power stroke of the first piston and a second power stroke of the second piston, and wherein the first power output shaft and the second power output shaft are on opposite sides of the first piston and the second piston.

2. The engine of claim 1 further comprising:

a fourth piston having a fourth end forming a fourth piston head, the second piston rod being attached to the fourth piston at a second end of the fourth piston opposite the first end of the fourth piston, wherein the second piston and the fourth piston are independently connected to the second piston rod by a second pin.

3. The engine of claim 2 further comprising:

a first cylinder head at a first end of the cylinder; and a second cylinder head at a second end of the cylinder, wherein the third piston moves toward the first cylinder head during the first power stroke of the first piston, and wherein the fourth piston moves toward the second cylinder head during the second power stroke of the second piston.

4. The engine of claim 3 further comprising:

a housing;

a first end plate sealing a first open end of the housing; and a second end plate sealing a second open end of the housing, wherein a section of the first end plate forms the first cylinder head, and a section of the second end plate forms the second cylinder head.

5. The engine of claim 4 wherein:

the housing comprises a pair of housing sections, the pair of housing sections are connected by a bearing, and the first power output shaft rotates in the bearing.

6. The engine of claim 3 further comprising:

a cylinder block that divides the combustion chamber in the cylinder into a first combustion chamber volume adjacent the first piston head and a second combustion chamber volume adjacent the second piston head.

7. The engine of claim 6 wherein:

the cylinder block includes a first fuel intake port for providing a fuel to the first combustion chamber volume and a second fuel intake port for providing the fuel to the second combustion chamber volume.

8. The engine of claim 7 wherein:

the third piston head defines a second combustion chamber in the cylinder between the third piston head and the first cylinder head, the first cylinder head includes a third fuel intake port for providing a fuel to the second combustion chamber, the fourth piston head defines a third combustion chamber in the cylinder between the fourth piston head and the second cylinder head, the second cylinder head includes a fourth fuel intake port for providing a fuel to the third combustion chamber.

9. The engine of claim 8 wherein:

the cylinder block includes a spark device for igniting fuel in the first combustion chamber volume and the second combustion chamber volume, the first cylinder head includes a spark device for igniting fuel in the second combustion chamber, and the second cylinder head includes a spark device for igniting fuel in the third combustion chamber.

10. The engine of claim 1 further comprising:

a first air compression chamber;

a first compression plate slidingly arranged in the first air compression chamber, the first compression plate being in sealing contact with an inner surface of the first air compression chamber; and a first compression rod connected to the first piston rod and the first compression plate, wherein the first compression plate compresses air in the first air compression chamber upon movement of the first piston rod.

11. The engine of claim 10 further comprising:

a first fluid pump chamber;

a first pump plate slidingly arranged in the first fluid pump chamber, the first pump plate being in sealing contact with an inner surface of the first fluid pump chamber; and a first pump rod connected to the second piston rod and the first pump plate, wherein the first pump plate pumps fluid from the first fluid pump chamber upon movement of the second piston rod.

12. The engine of claim 11 further comprising:

a housing having a first channel in fluid communication with the first air compression chamber for transporting air from the first air compression chamber and a second channel in fluid communication with the first fluid pump chamber for transporting fluid from the first fluid pump chamber.

13. The engine of claim 1 wherein:

the first piston rod is attached to the first piston such that the first piston rod extends diametrically across the second end of the first piston, and the second piston rod is attached to the second piston such that the second piston rod extends diametrically across the second end of the second piston.

14. The engine of claim 1 further comprising:

a drive gear connected to the first power output shaft.

15. The engine of claim 14 further comprising:

a drive element selected from chains and belts, wherein the drive element is coupled to the drive gear.

16. The engine of claim 1 wherein:

The first connecting rod is coupled to the second power output shaft, and the second connecting rod is couple to the second power output shaft.

17. The engine of claim 16 wherein:

the first power output shaft and the second power output shaft are coaxial.

18. The engine of claim 17 wherein:

the first connecting rod is linked to a first set of cams, the second connecting rod is linked to each of the first set of cams, the second connecting rod is linked to a second set of cams, and one cam of the second set of cams is connected to the first power output shaft, and another cam of the second set of cams is connected to the second power output shaft.

19. The engine of claim 18 wherein:

the second connecting rod includes a pair of spaced apart arms defining a yoke such that the first connecting rod and the first set of cams can move between the pair of spaced apart arms.

20. The engine of claim 1 further comprising:

a fuel intake port in fluid communication with the interior space of the cylinder; and an exhaust port in fluid communication with the interior space of the cylinder, wherein the fuel intake port and the exhaust port are located in opposite ends of the cylinder.

21. The engine of claim 1 wherein:

the first piston rod is perpendicular to a longitudinal axis of the cylinder when the first piston is near bottom of its stroke, and the second piston rod is perpendicular to the longitudinal axis of the cylinder when the second piston is near top of its stroke.

* * * * *